US006210502B1

(12) United States Patent
Takahashi

(10) Patent No.: US 6,210,502 B1
(45) Date of Patent: Apr. 3, 2001

(54) PROCESSING METHOD FOR HIGH-PURE TITANIUM

(75) Inventor: Shoichi Takahashi, Chigasaki (JP)

(73) Assignee: Toho Titanium Co., Ltd., Chigasaki (JP)

( * ) Notice: Subject to any disclaimer, the term of this patent is extended or adjusted under 35 U.S.C. 154(b) by 0 days.

(21) Appl. No.: 09/217,837

(22) Filed: Dec. 22, 1998

(30) Foreign Application Priority Data

Dec. 24, 1997 (JP) ..... 9-366484
Dec. 22, 1998 (JP) ..... 10-364631

(51) Int. Cl.[7] ..... C22F 1/18
(52) U.S. Cl. ..... 148/670; 148/421
(58) Field of Search ..... 148/670, 421

(56) References Cited

U.S. PATENT DOCUMENTS 3,492,172 * 1/1970 Sauvageot et al. ..... 148/670
5,196,916 3/1993 Ishigami et al. ..... 257/769
5,772,860 * 6/1998 Sawada et al. ..... 204/298.13
5,798,005 * 8/1998 Murata et al. ..... 148/421

FOREIGN PATENT DOCUMENTS 8-232061 9/1996 (JP) .
8-269698 10/1996 (JP) .
8-333676 12/1996 (JP) .

OTHER PUBLICATIONS

"Metals Handbook, Ninth Edition, vol. 14, Forming and Forging", ASM International Handbook Committee, 1988, pp. 838–848, p. 3.*

* cited by examiner

*Primary Examiner*—John Sheehan
*Assistant Examiner*—Andrew L. Oltmans
(74) *Attorney, Agent, or Firm*—Oliff & Berridge, PLC

(57) ABSTRACT

The invention provides a processing method for a high-pure titanium having fine grains by cold forging, through which the processing steps are simplified and scale growth is prevented. The invention uses high-pure titanium having a purity of 4N or higher (99.99%, except for gas inclusions), and forges the titanium raw material in the temperature range from room temperature to 300° C., then anneals the titanium raw material in the temperature range from 400 to 600° C.

5 Claims, 1 Drawing Sheet

PROCESSING METHOD FOR HIGH-PURE TITANIUM

BACKGROUND OF THE INVENTION

This invention relates to the processing methods for the high-pure titanium, and more specifically, to the working methods for the high-pure titanium suitable for a titanium target for sputtering. In more detail, the invention relates to the methods of a cold plastic working for the titanium material (raw material) having a purity higher than 4N so as to obtain the titanium material having a fine grain size.

In manufacturing semiconductor devices, sputtering, vacuum deposition or ion plating is employed for forming a circuit material or a barrier metal in the form of a film on a semiconductor element. Of those methods, sputtering is generally used in practice. In sputtering, ions such as argon ions impact on a metallic target, thereby ejecting the metal ions, and which are piled on a base plate, resulting in forming a film. Many kinds of metallic targets are known, and among these, titanium targets are widely used for the semiconductor devices.

In order to produce a uniform thickness of the film on the semiconductor element, and to control the occurrence of so-called "particles" (which means a phenomenon that some large particles adhere on the film surface in spattering), the grain size of titanium targets must be about 20 μm or smaller. After preparing the titanium material by forging and rolling, the grain size is controlled by recrystallization and annealing to satisfy the requirements for the titanium target mentioned above. For example, Japanese Patent Unexamined Publication (Kokai) No. 8-232061 discloses a method that the matrix of a titanium ingot was broken by drawing and upsetting in the temperature higher than the transformation temperature (882° C.), and performing the same forging as mentioned above in the temperature lower than that of the transformation. The disclosed method allows the matrix to accumulate working strain so as to reduce the grain size in the matrix. In addition, Japanese Patent Unexamined Publication (Kokai) No. 8-269698 and No. 8-333676 discloses a method that the grain size in the titanium targets are reduced by rolling or forging in the temperature lower than that of the transformation.

The conventional methods disclosed in the publications for reducing the grain size require at least a heating equipment in forging and/or rolling at a temperature from 400 to 800° C., leading to the high operation cost regarding such as an electric consumption, thereby having disadvantages in view of the cost. In addition, the methods mentioned above accompany the scale growth on the surface of the titanium material, and the additional descaling process, which complicates the subsequent process.

An object of the invention is to provide a method for processing the high-pure titanium having an average grain size of 50 μm or smaller, preferably of 40 μm or smaller, and more preferably of 35 μm or smaller, in which the scale growth is prevented and at comparatively low cost.

DISCLOSURE OF THE INVENTION

The inventors forged the high-pure titanium having a purity of 4N (99.99%, except for gas inclusions) and an amount of other gas impurities of O, N and C less than 600 ppm in the temperature lower than that of the transformation, and studied the matrix structure of the resultant material. As a result, they have found that;

(a) the cracks are not found through cold forging;

(b) the grain size distribution of the titanium material obtained by annealing the forged material is uniform;

(c) the grain size is reduced in the range smaller than 35 μm or further 20 μm;

(d) the scale growth is prevented on the surface of the titanium material.

The invention is completed based on the above-mentioned studies. The invention provides a processing method for the high-pure titanium wherein the cold plastic working are performed for the titanium raw material, having a purity of 4N or higher (hereinafter referred to as "titanium raw material"). It should be noted that the term "cold" refers to the temperature of the titanium raw material before forging, and the temperature moves in the range from room temperature to 300° C. The temperature elevation of the titanium material itself does not affect the effects of the invention.

The details of the invention are explained hereinafter. The titanium raw material employed for the plastic working is a high-pure titanium having a purity of 4N or higher. The resulting material obtained by the plastic working is referred to as "titanium worked material", specifically the material obtained by the forging is referred to as "titanium forged material". The essential reason the plastic working can be easily performed on the titanium raw material at room temperature or near the room temperature before forging is that the titanium raw material has a workability sufficient for the cold working when the impurity content thereof is in the above-mentioned range.

Therefore, the invention offers better effects or advantages as the purity of the titanium raw material increases. The titanium raw material can be used for the ductile materials, wire rods and targets. When further uniformity of grain size distribution are required for the titanium worked material used for the targets, warm forging may be preferable after cold forging so as to obtain titanium raw materials having a more uniform grain size distribution. It should be noted that the term "warm" refers to the temperature before the forging of the titanium raw material and the temperature ranges from 300 to 600° C., in which a suitable temperature depends on the condition of the titanium raw material.

The processing method for the high-pure titanium of the invention will be explained in detail hereinafter.

The invention uses the high-pure titanium having a purity of 4N or higher (99.99%, except for gas inclusions) as a raw material. That is, when the oxygen content is high, the titanium raw material cannot offer the sufficient workability, so that the worked titanium materials having the uniform grain size cannot be obtained even if the titanium raw material has a high purity. Therefore, the total amount of the gas impurities such as O, N and C is preferably less than 600 ppm, and the amount of oxygen is preferably less than 500 ppm.

The titanium raw material accumulates the working strain by the plastic working in the low temperature, namely in the range from room temperature to 300° C., and simultaneously is formed into a titanium material having a suitable shape (for example a plate) corresponding to the various applications. The plastic working according to the invention includes working methods such as forging, plate milling, rod milling, wire drawing, drawing, upsetting and the like. The forging is the most suitable for producing the titanium worked materials used for targets.

When titanium ingots or billets are used as a titanium raw material, the raw material is generally heated up to the temperatures of 400° C. or higher in forging. The titanium raw material of the invention has a good workability since it has a purity of 4N or higher, so that the forging is easily applicable at the temperature of 300° C. or lower.

When the titanium raw material at room temperature is forged, the material itself may be heated up to the temperature of 300° C. or higher in some situations. When the titanium material is heated up to the temperature of 300° C. or higher in forging, the working strain accumulated in the titanium raw material is liberated, so that the grain size is not reduced by the subsequent annealing. Therefore, the temperature elevation of the titanium raw material should be restricted and the temperature should be maintained in the temperature of 300° C. or lower to reduce the grain size through the subsequent annealing. In order to restrict the temperature elevation, the titanium raw material in forging may be cooled, or the forging die may be cooled by air.

The titanium forged material obtained by the forging is annealed in the temperature range from 400 to 600° C., so that the titanium forged material of the invention is produced. The obtained titanium forged material has fine grains and an uniform grain size distribution. The annealing can be omitted after cold forging according to the use of the titanium worked material.

In order to obtain the further fine and uniform grain size, the warm forging may be employed after the cold forging. The temperature of the titanium raw material in the warm forging is preferably chosen in the range from 300 to 600° C., and more preferably from 400 to 500° C., considering the effects of the warm forging and the oxygen contamination of the titanium raw material in heating.

When the titanium forged material requires further fine and uniform grain size, cold forging in the range from room temperature to 300° C. may be preferable again after the cold forging, and annealing in the temperature range from 400 to 600° C. may be employed. Thus obtained titanium forged material reveals extremely a fine grain size and an excellent uniformity of the grain size.

Moreover, when the further fine and uniform grain size are required, rapid cooling such as water quenching may be preferable after the cold forging and annealing; then, cold forging in the range from room temperature to 300° C. and the subsequent annealing in the range from a temperature ranging from 400 to 600° C. may be preferable. The series of steps can be repeated. The titanium forged material mentioned above has a further fine and an excellent uniformity of grain size.

When the high-pure titanium having a purity of 5N (99.999%, except for gas inclusions) and the total amount of gas impurities such as O, N and C is less than 300 ppm, the cold forging in the range from room temperature to 200° C. is effective for reducing the grain size of the titanium worked material further.

According to the embodiment of the processing methods for the titanium worked materials, the present forging is performed in the cold temperature range lower than that in the conventional hot forging, the heating step is skipped and the production cost can be reduced. Moreover, the heating step is skipped in the forging, and therefore, the scale growth is prevented, the yield is thereby improved. It should be noted that when a relatively large ingot is employed for the titanium raw material, as the grain size of the material is coarse, preferably, the preliminary hot forging is performed to break the coarse grains; then cold forging is performed.

DETAILED DESCRIPTION OF THE INVENTION

Figure 1A:
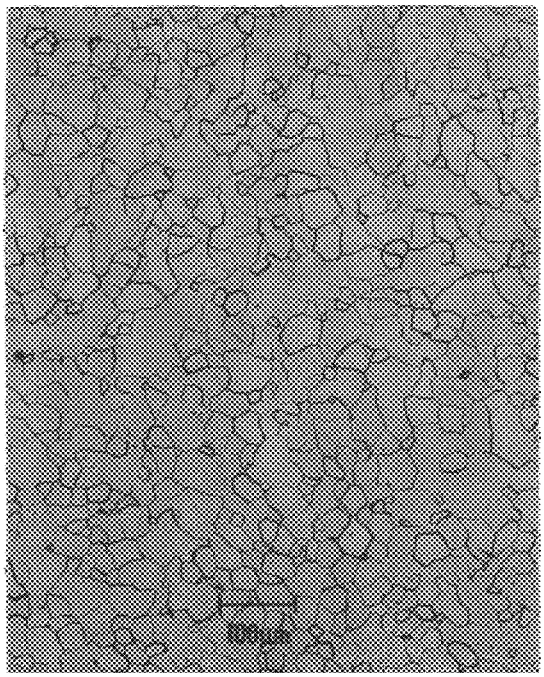
FIG. 1A depicts the grain size of the top portion (A) in the longitudinal direction of the titanium forged material of Example 4 according to the invention.

The effects and the advantages of the invention will be explained referring to the examples of the invention.

Tables 1 and 2 show the chemical analysis of the high-pure titanium employed for each example and comparative example.

TABLE 1

| Element | Fe | Cr | Ni | Na | K | Th | U | O | C | N |
|---|---|---|---|---|---|---|---|---|---|---|
| Chemical analysis (ppm) | 5 | <1 | 2 | <0.1 | <0.1 | 0.001 | 0.001 | 300 | 20 | 30 |

TABLE 2

| Element | Fe | Cr | Ni | Na | K | Th | U | O | C | N |
|---|---|---|---|---|---|---|---|---|---|---|
| Chemical analysis (ppm) | 2 | <1 | 2 | <0.02 | <0.02 | <0.001 | <0.001 | 160 | 20 | 30 |

EXAMPLE 1

A titanium ingot having a purity of 4N5 shown in Table 1 with a diameter of 350 mm and a length of 500 mm was prepared by electron beam melting. The ingot was heated up to 800° C. and forged to fabricate a billet with a diameter of 50 mm. Then, the free forging was applied to the billet by a press machine at a pressure of 1000 tons, which billet was formed into a 5 mm thick plate. The plate was annealed in air at 400° C. for one hour so as to obtain a titanium forged material.

EXAMPLE 2

A titanium ingot having a purity of 4N5 shown in Table 1 with a diameter of 350 mm and a length of 500 mm was prepared by electron beam melting. The free forging was applied to the ingot at room temperature by the press machine at a pressure of 1000 tons, which ingot was formed into a billet with a diameter of 150 mm. The billet was annealed in air at 400° C. for one hour so as to obtain a titanium forged material.

EXAMPLE 3

A titanium ingot having a purity of 4N5 shown in Table 1 with a diameter of 350 mm and a length of 500 mm was prepared by electron beam melting. The free forging was applied to the ingot at room temperature by the press machine at a pressure of 1000 tons, which ingot was formed into a billet with a diameter of 150 mm. The billet was rolled into a 5 mm thick plate at 400° C. The plate was annealed in air at 500° C. for one hour so as to obtain a titanium forged material.

EXAMPLE 4

A titanium ingot having a purity of 4N5 shown in Table 1 with a diameter of 240 mm and a length of 500 mm was prepared by electron beam melting. The free forging was applied to the ingot at room temperature by a 1000 tons press machine, which ingot was formed into a billet with 175 mm square. The billet was annealed in air at 500° C. for five hours, and rapidly cooled through water quenching. Then, the tap forging was applied to the billet which was formed into a billet with a diameter of 165 mm, by a 800 tons press machine at room temperature and annealed in air at 475° C. for two hours and at 500° C. for four hours so as to obtain a titanium forged material.

EXAMPLE 5

A titanium ingot having a purity of SN shown in Table 2 with a diameter of 240 mm and a length of 500 mm was prepared by electron beam melting. The free forging was applied to the ingot at room temperature by a 1000 tons press machine, which ingot was formed into a billet with a diameter of 165 mm. The billet was annealed in air at 450° C. for two hours and then annealed at 475° C. for four hours so as to obtain a titanium forged material.

COMPARATIVE EXAMPLE 1

A titanium ingot having a purity of 4N5 shown in Table 1 with a diameter of 350 mm and a length of 500 mm was prepared by electron beam melting. The free forging was applied to the ingot at 700° C. by the 1000 tons press machine, which ingot was formed into a billet with a diameter of 150 mm. The billet was annealed in air at 700° C. for two hours so as to obtain a titanium forged material.

COMPARATIVE EXAMPLE 2

A titanium ingot having a purity of 4N5 shown in Table 1 with a diameter of 520 mm and a length of 500 mm was prepared by consumable vacuum arc melting. The ingot was heated up to 950° C. and the free forging was applied to the ingot by a 1000 tons press machine, which was formed into a billet with a diameter of 300 mm. The billet was heated again up to 950° C. and the free forging was applied by a 1000 tons press machine, which was formed into a billet having an octagonal cross section with a diameter of 230 mm. Then, the billet was heated up to 800° C. and the tap forging was applied to the billet by a 800 tons press machine, which was formed into a billet with a diameter of 150 mm. Then, the billet was annealed in air at 675° C. for two hours and then annealed at 700° C. for four hours so as to obtain a titanium forged material.

Figure 1B:
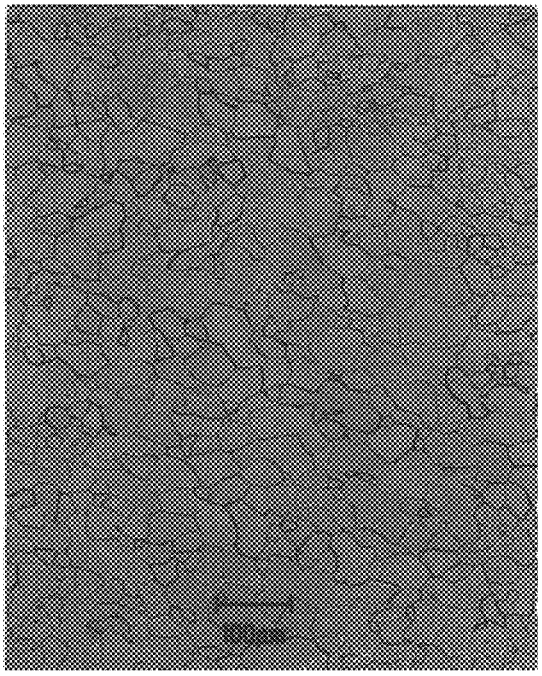
FIG. 1B depicts the grain size of the bottom portion (B) in the longitudinal direction of the titanium forged material of Example 4 according to the invention.

The matrix structure obtained in Examples 1 to 5 and Comparative Examples 1 and 2 were examined by the optical microscope based on the ASTM line segment method, and the sizes and the uniformity of the grain size were evaluated. The evaluated results are shown in Table 3 together with a presence of a crack in the billet. In the evaluation of uniformity, "○" indicates that the uniformity is sufficient for the titanium target material, and "◎" indicates that the uniformity is excellent in FIG. 1A shows microscopic photographs of the grains in the top portion (A) in the longitudinal direction of the titanium forged material according to Example 4, and FIG. 1B shows microscopic photographs of the grains in the bottom portion (B) in the longitudinal direction of the titanium forged material according to Example 4.

TABLE 3

| | Average Grain Size (μm) | Uniformity | Presence of Crack |
|---|---|---|---|
| Example 1 | 4 | ○ | None |
| Example 2 | 8 | ○ | None |
| Example 3 | 14 | ◎ | None |
| Example 4 | 32 | ◎ | None |
| Example 5 | 16 | ◎ | None |
| Comparative Example 1 | 100 | ○ | None |
| Comparative Example 2 | 300 | ◎ | None |

As shown in Table 3, Examples 1 to 5 satisfy the requirements for the grain size and the uniformity of the grains for titanium targets, and reveals no crack in cold forging, so that the titanium worked materials suitable for the target were obtained. In contrast, Comparative Examples 1 and 2 represent the coarse grain, although they do not have cracks. Therefore, Comparative Examples are not suitable for the titanium targets. Moreover, as shown in FIGS. 1A and 1B, the titanium forged material according to the invention has relatively uniform particle size in the top portion (A) and the bottom portion (B) in the longitudinal direction, and does not present the remarkable differences between the matrix in the top portion (A) and that in the bottom portion (B).

As mentioned above, the processing method for the high-pure titanium according to the invention can provide the titanium worked material having the fine and uniform grain size by the cold plastic working for a titanium raw material with a purity of 4N or higher. In addition, the invention can simplify the processing steps, thereby reduce the production cost, and prevent the scale growth.

What is claimed is:

1. A processing method for performing plastic working on a high-pure titanium ingot, said method consisting essentially of:

performing a cold forging on a titanium ingot as cast having a purity of 99.99% or more keeping the temperature of the ingot ranging from room temperature to 300° C.; and annealing the titanium ingot at a temperature ranging from 400 to 600° C.

2. A processing method for performing plastic working on a high-pure titanium ingot according to claim 1, wherein the cold forging and the annealing are repeated.

3. A processing method for performing plastic working on a high-pure titanium ingot according to claim 1, wherein a rapid cooling is performed after the annealing.

4. A processing method for performing plastic working on a high-pure titanium ingot according to claim 1, wherein an oxygen content of the titanium ingot is 500 ppm or less.

5. A processing method for performing plastic working on a high-pure titanium ingot according to claim 1, wherein the temperature of the titanium ingot during the cold forging is controlled by cooling to 300° C. or less.

* * * * *